US005700201A

United States Patent [19]

Bellows et al.

[11] Patent Number: 5,700,201

[45] Date of Patent: Dec. 23, 1997

[54] CHILD ENTERTAINMENT DEVICE WITH FLEXIBLE SUPPORT LEGS

[75] Inventors: William Bellows, Sinking Springs; Paul Nelson, Elverson; Mark Messner, Reading, all of Pa.

[73] Assignee: Graco Children's Products Inc., Elverson, Pa.

[21] Appl. No.: 555,531

[22] Filed: Nov. 9, 1995

[51] Int. Cl.[6] ..... A63G 13/08

[52] U.S. Cl. ..... 472/103; 472/105; 297/137

[58] Field of Search ..... 472/95, 100, 103, 472/104, 105, 135; 297/137, 344.18; 482/77, 66, 68; 280/87.051

[56] References Cited

U.S. PATENT DOCUMENTS

| | | | |
|---|---|---|---|
| 2,709,079 | 5/1955 | Bubb et al. | 472/135 X |
| 2,978,245 | 4/1961 | Rempel | 472/105 |
| 3,494,613 | 2/1970 | Hatfield | 472/135 |
| 5,407,246 | 4/1995 | Meeker et al. | 297/137 |
| 5,415,590 | 5/1995 | Steingraber et al. | 472/103 |
| 5,433,682 | 7/1995 | Fermaglich et al. | 482/66 |

*Primary Examiner*—Kien T. Nguyen

*Attorney, Agent, or Firm*—Morgan, Lewis & Bockius LLP

[57] ABSTRACT

An improved child entertainment device includes a base, supporting legs, and a child support structure. The support legs include a rigid section and a flexible section, the flexible section being located proximate to the base to maximize the up and down and side to side range of motion available to the child. The entertainment achieved by the child is therefore increased.

16 Claims, 3 Drawing Sheets

CHILD ENTERTAINMENT DEVICE WITH FLEXIBLE SUPPORT LEGS

BACKGROUND OF THE INVENTION

1. Field of the Invention

The present invention relates to a child entertainment device, and in particular, to such a device with support legs equipped with a flexible section to provide a wide range of motion.

2. Description of the Related Art

Conventional child entertainment devices (or activity center devices) are generally non-moving structures that support a child in an upright position, allowing the child's feet to touch the ground and providing the child with the sensation of standing upright. Such child entertainment may contain a waist-high tray section and a seat on which the child sits.

Conventional child entertainment devices include a spring device to allow the child to bounce when the child pushes upward with his or her legs. The more flexible the spring device, the larger the range of motion available to the child. However, the spring device cannot be too flexible because the child typically cannot support its own weight. Thus, the spring device must be flexible while also being able to support the weight of the child entertainment device and the child.

Conventional child entertainment devices have the disadvantage of being only slightly flexible, particularly in response to the relatively weak leg muscles of the typical child user, and accordingly have a limited range of motion.

SUMMARY OF THE INVENTION

An object of the present invention is to provide a child entertainment device that maximizes the entertainment achieved by the child. Another object of the present invention is to provide a child entertainment device with a support leg that is sufficiently strong and rigid to support both the weight of the child entertainment device and the weight of the child while being simultaneously flexible enough to allow the child, through use of his or her own movements, to safely bounce and sway within a very wide range of motion. Yet another object of the present invention is to provide a support leg for a child entertainment device that is visually attractive yet safe for the child.

To achieve these and other advantages and in accordance with the purpose of the invention, as embodied and broadly described, the invention provides for a child entertainment device with improved stability and range of motion comprising a base structure, a plurality of support legs connected to the base structure, each support leg having a rigid section and a flexible section, the flexible section disposed proximate to the base structure and disposed below the rigid section, and a child support structure including a child seat connected to the plurality of support legs.

In another aspect, the invention provides for a flexible support leg for a child entertainment device having a base and a child support structure, the leg comprising a flexible portion disposed proximate to the base, and a rigid portion connected to the flexible portion and connected to the child support section.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention and together with the written description serve to explain the principles of the invention. In the drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
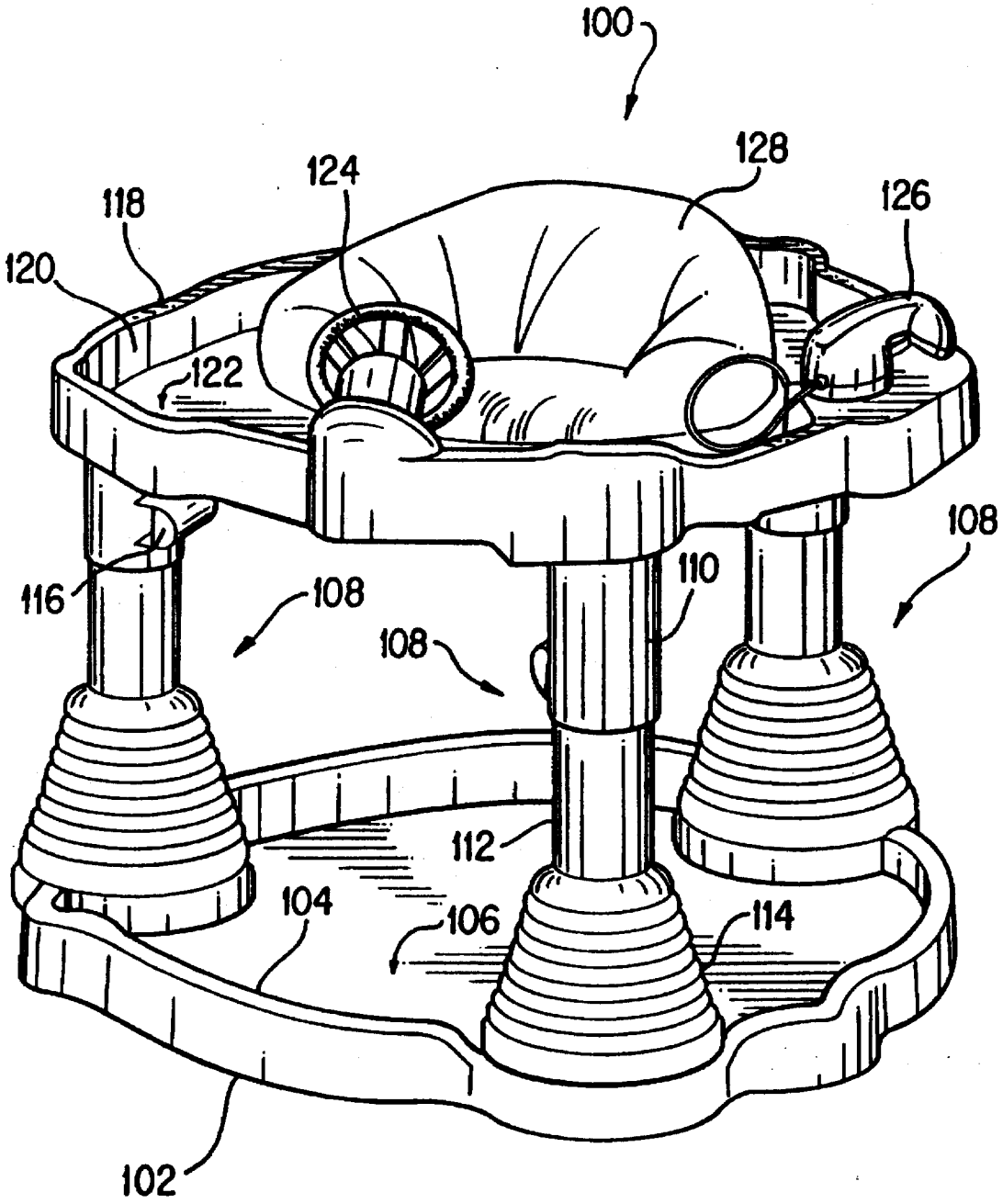
FIG. 1 is a perspective view of the child entertainment device according to the present invention.

FIG. 1 shows a child entertainment device 100 in accordance with a preferred embodiment of the present invention. Generally, the child entertainment device 100 includes a base structure 102, a plurality of support legs 108, a tray structure 118, and a child seat 128. As explained in more detail below, the child entertainment device 100 of the present invention provides several novel features which solve the problems of conventional devices.

The base structure 102 includes a lip 104 and a central flat area 106. The base structure 102 provides a stable platform on which the child entertainment device 100 may rest during use, and is preferably formed of a rigid plastic material. The lip 104 provides structural rigidity to the base structure. The flat area 106 provides a region for the child's feet to be located during use and allows the child a wide range of foot movement.

In the preferred embodiment, the child entertainment device 100 includes 3 support legs 108 as shown in FIG. 1. The support legs 108 provide a flexible yet stable support structure for the tray structure 118 and the child seat 128 and provide for a very wide range of motion. In accordance with the invention, the support leg includes a rigid section and a flexible section. The support leg 108 includes an outer sleeve 110 and an inner sleeve 112 as a rigid section, and a lower boot 114 covering a flexible section. The outer sleeve 110 is attached to the tray structure 118 and is formed preferably of a rigid plastic material. The inner sleeve 112 is formed preferably of a rigid plastic material, and is adapted to slide within the inner circumference of the outer sleeve 110 to provide height adjustment of each support leg 108. The height can be adjusted to the size of the child.

The lower boot 114 is connected to the inner sleeve 112 at the top, and is also connected to the base structure 102 at the bottom. As can be seen, the lower boot structure is a generally circular structure which increases in circumference from the upper portion to the lower portion and is preferably provided with several concentric ridges to allow for the flexible motion of the support leg 108 in any direction. The lower boot 114 encloses a flexible structure, described in detail below, and serves to prevent the child from accessing that flexible structure. In particular, the lower boot 114 protects the child's feet and toes from being entangled in the flexible structure.

A height adjustment button 116 is provided on the outer sleeve 110 to adjust the height of the support leg. In particular, by depressing the height adjust button 116, the inner sleeve 112 may be moved within the outer sleeve 110 to adjust the height of the support leg 108. When the desired height has been achieved, the height adjust button 116 is released to lock the outer sleeve 110 and the inner sleeve 112 in position. In the preferred embodiment, the height adjust button 116 is spring biased and includes a longitudinal member with a tab (not shown) therein. The inner sleeve 112 preferably includes a notched portion (not shown) which freely slides within the outer sleeve 110 when the button is depressed. When the button is released, the longitudinal tab member engages the notched portion of the inner sleeve 112 to lock the inner sleeve 112 and outer sleeve 110 in the desired position. In the preferred embodiment, several stops are provided in the notched portion to allow for several separate height positions. In the most preferred structure, three height positions and a storage position with the support leg fully collapsed are provided. Of course, other numbers of positions can be provided.

The upper tray 118 is preferably formed of a rigid plastic material and includes a lip 120 and a generally flat surface 122. The lip 120 provides structural rigidity to the upper tray 118, and further provides the advantage of containing any spills or toys used by the child. The flat surface 122 generally provides an area for the storage of food, toys, or drink. In the preferred embodiment, the upper tray 118 further includes various novelty items incorporated into the upper tray structure to entertain the child. As shown in FIG. 1, the upper tray 118 includes a steering wheel 124 and a telephone 126 which may be used by the child for amusement. Of course, it should be understood that other novelty items may be included in the upper tray 118 such as noise makers, bead toys, or the like.

A child seat 128 is located in an interior portion of the upper tray 118. As can be seen in FIG. 1, child seat 128 generally includes a back portion which extends upwardly to provide support to the child's back and a front portion having a lower edge to allow the child access the various entertainment devices with the hands. The child seat is preferably made of a soft, cushioned material for the comfort of the child, and generally includes two leg holes (not shown) in a cloth structure covering the opening of the child seat to allow the child's legs to pass through and reach the flat surface 106 of the base structure 102. The cloth structure generally provides some support for the child while the child provides some support with his or her legs.

The child seat 128 is preferably capable of rotation within the upper tray 118 to allow the child to face in any desired direction. In the preferred embodiment, the child seat 128 is interconnected with the upper tray 118 with a ball bearing structure which is sealed to prevent the ball bearings from coming loose from the structure and potentially being ingested or aspirated by the child.

Figure 2:
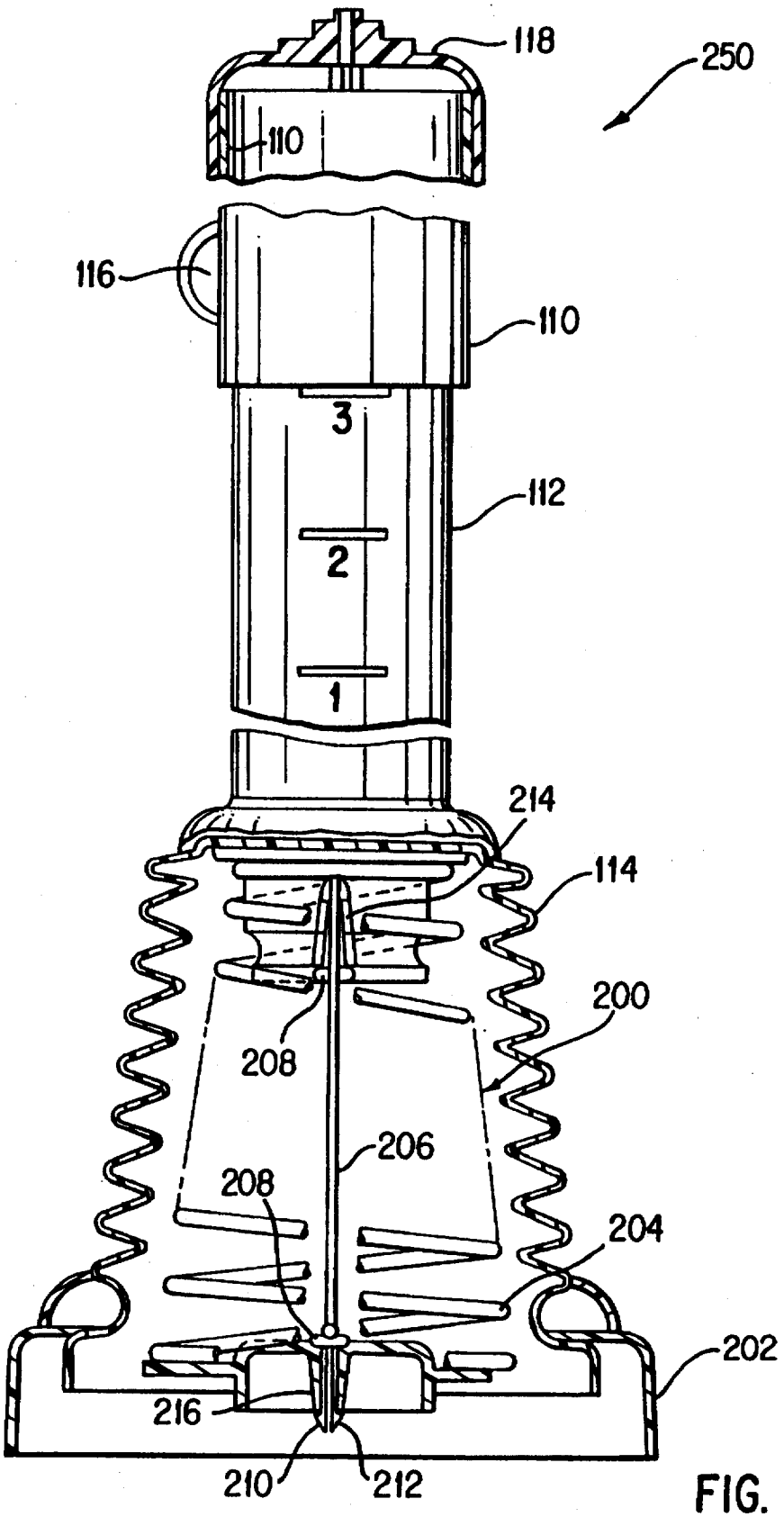
FIG. 2 is a sectional and cut-away view of a support leg according to the present invention.

FIG. 2 shows a more detailed view of the support leg 108. In particular, FIG. 2 shows a flexible structure 200 contained in the interior of the lower boot 114. The flexible structure 200 provides a flexible interconnection between the inner sleeve 112 and a mounting base 202. The mounting base 202 is preferably structurally integrated within the base structure 102 (not shown in FIG. 2).

Flexible structure 200 preferably includes a spring device and a motion limiting device. The motion limiting device generally is used to prevent unnecessary or unsafe flexibility, rebound, or range of motion of the flexible structure. In the preferred embodiment, the spring device includes a helically wound coil spring 204 with a radius that increases from top to bottom, and is formed of conventional spring steel. Of course, a straight compression spring could also be used. The top of the spring 204 is connected to the lower portion of the inner sleeve 112, and the bottom of the spring 204 is connected to the mounting base 202. The spring 204 provides the flexible connection between the inner sleeve and the mounting base 202.

In the preferred embodiment, the motion limiting device includes a strap 206 provided within the central area of the spring 204 and connected at one end to the lower portion of the inner sleeve 112 and at the other end to the mounting base 202. The strap 206 is preferably comprised of a webbed cloth material, and serves to restrict the expansion of the spring 204 while allowing a full range of compression and side to side motion of the support leg. In the preferred embodiment, the strap 206 is set to an appropriate length to maintain the spring 204 in a somewhat compressed state.

It should be understood, of course, that the motion limiting device can include structures other than the preferred strap 206 to prevent unnecessary or unsafe flexibility, rebound, or range of motion. For example, a string or plastic strap could be used.

Figure 3:
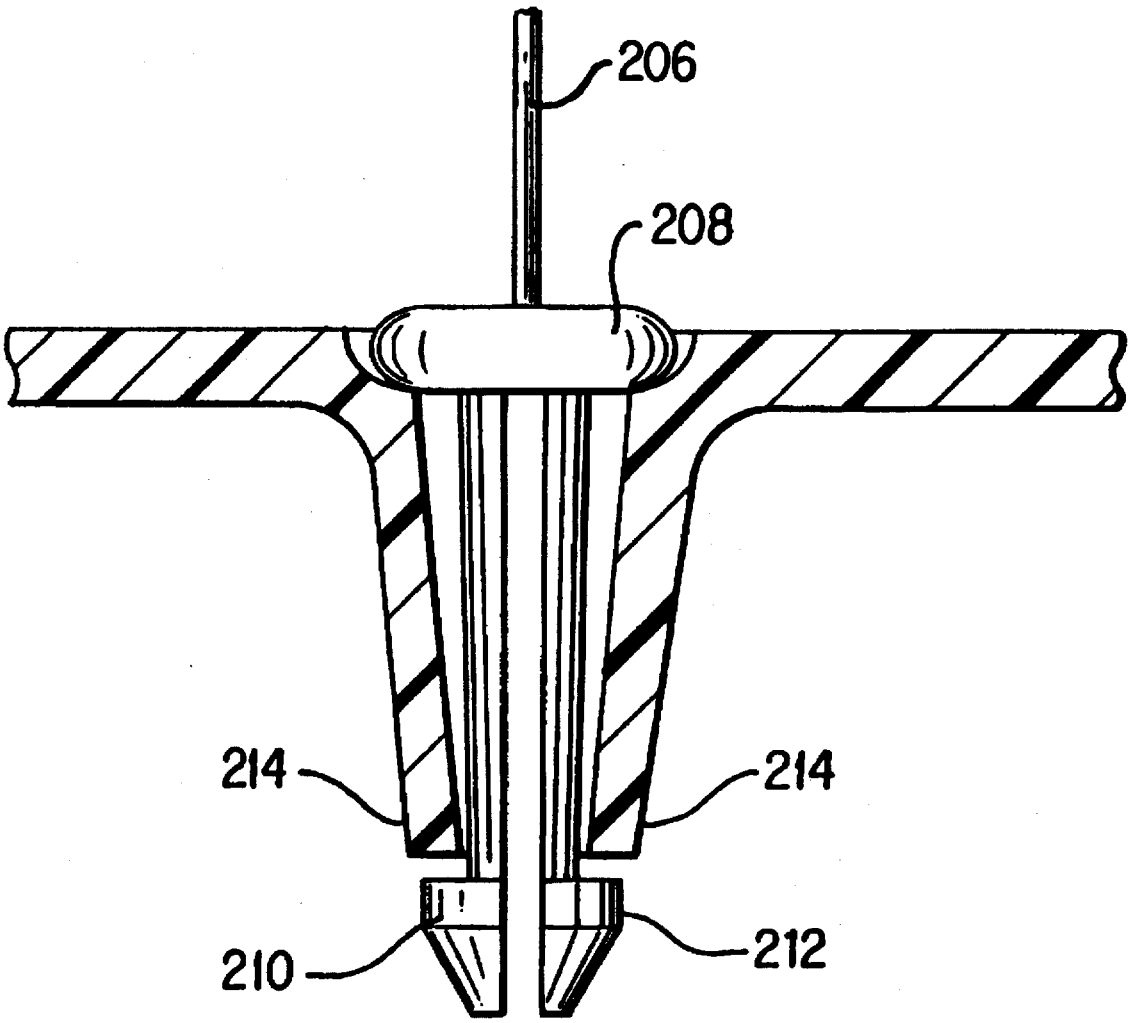
FIG. 3 is a sectional view of connection device according to the present invention.

At each end of the strap is included a connection device 208 which extends from the end of the webbing material. The connection device 208 preferably includes a pair of extensions 210 and 212. The extensions 210 and 212 are adapted to be inserted into an appropriate receiving hole 214 within the lower end of the inner sleeve 112 and an appropriate receiving hole 216 within the mounting base 202. An enlarged view of the connection device and the receiving hold 214 is also shown in FIG. 3. Extensions 210 and 212 preferably include wedge-shaped tabs at the anterior end which are inserted into the receiving hole. The receiving hole expands as the wedge-shaped tabs are inserted and then snaps back to firmly secure the coupling member 208 to the inner sleeve 112 and the mounting base 202, respectively.

A sectional view 250 of the inner sleeve 112 and the outer sleeve 110 is shown in the upper portion of FIG. 2. The sectional view shows the inner sleeve 112 located within the outer sleeve 110, and shows a top section of the outer sleeve 110 abutting against the bottom surface of the upper tray 118.

During use, the child is located in the child seat 128 with the feet extending through to the flat area 106 of the base structure 102. The weight of the child will slightly compress the flexible structure 200. When the child pushes down and/or to the side with his or her feet, the support legs will expand upward and/or angulate to the side, respectively. The motion limiting device limits the upward expansion of the flexible structure to prevent over-bouncing by the child and excessive tipping of the tray.

The compression of one side of the flexible structure (and concurrent expansion of the opposite side) during angulation limits the amount of side to side motion of the child. Of course, it is preferable to locate the flexible section closer to base structure 102 to maximize the range of displacement of tray 118. Of course, the characteristics of the flexible structure are selected to prevent tipping of the child entertainment. As can be seen, the present invention provides the advantage of increased flexibility and range of motion, and in particular increased side to side movement, available to the child, thereby increasing the entertainment achieved by the child.

It will be apparent to those skilled in the art that various modifications and variations can be made in the support leg of the present invention without departing from the spirit or scope of the invention. Thus, it is intended that the present invention cover the modifications and variations of this invention provided they come within the scope of the appended claims and their equivalents.

What is claimed is:

1. A child entertainment device with an improved range of motion comprising:

a base structure;

a plurality of support legs connected to the base structure, each support leg having a rigid section and a flexible section, the flexible section disposed proximate to the base structure and disposed below the rigid section, the flexible section of the support leg including a spring connected to the rigid section and to the base structure and a motion limiting device to prevent excessive expansion of the spring; and a child support structure including a child seat connected to the plurality of support legs.

2. The child entertainment device of claim 1, wherein the base structure includes a lip and a flat area.

3. The child entertainment device of claim 1, wherein the rigid section of each support leg includes an outer sleeve and an inner sleeve located within the outer sleeve and adapted to slide within the outer sleeve to allow for height adjustment of the support leg.

4. The child entertainment device of claim 3, further comprising a height adjustment button for locking the inner sleeve and the outer sleeve at a desired height.

5. The child entertainment device of claim 1, wherein the flexible section of the support leg includes a lower boot structure.

6. The child entertainment device of claim 1, wherein the motion limiting device includes a strap connected to the rigid section and to the base structure.

7. A flexible support leg in a child entertainment device having a base structure and a child support structure, the leg comprising:

a flexible portion disposed proximate to the base structure, the flexible section including a spring connected to the rigid section and to the base structure and a motion limiting device to prevent excessive expansion of the spring; and a rigid portion connected to the flexible portion and connected to the child support section.

8. The child entertainment device of claim 7, wherein the rigid section of each support leg includes an outer sleeve and an inner sleeve located within the outer sleeve and adapted to slide within the outer sleeve to allow for height adjustment of the support leg.

9. The child entertainment device of claim 8, further comprising a height adjustment button for locking the inner sleeve and the outer sleeve at a desired height.

10. The child entertainment device of claim 7, wherein the flexible section of the support leg includes a lower boot structure.

11. The child entertainment device of claim 7, wherein the motion limiting device includes a strap connected to the rigid section and to the base structure.

12. The child entertainment device of claim 11, wherein the strap includes a coupling at each end adapted to connect to the rigid section and the base structure, respectively.

13. A child entertainment device with an improved range of motion comprising:

a base structure;

a plurality of support legs connected to the base structure, each support leg having a rigid section and a flexible section, the flexible section disposed proximate to the base structure and disposed below the rigid section, the flexible section allowing the rigid section to move vertically with respect to the base structure, and the rigid section of each support leg including an outer sleeve and an inner sleeve located within the outer sleeve and adapted to slide within the outer sleeve to allow for height adjustment of the support leg; and a child support structure including a child seat connected to the plurality of support legs.

14. The child entertainment device of claim 13, further comprising a height adjustment button for locking the inner sleeve and the outer sleeve at a desired height.

15. A flexible support leg for a child entertainment device having a base structure and a child support structure, the leg comprising:

a flexible portion disposed proximate to the base structure; and a rigid portion connected to the flexible portion and connected to the child support section, the flexible portion allowing the rigid portion to move vertically with respect to the base structure, the rigid portion of each support leg including an outer sleeve and an inner sleeve located within the outer sleeve and adapted to slide within the outer sleeve to allow for height adjustment of the support leg.

16. The child entertainment device of claim 15, further comprising a height adjustment button for locking the inner sleeve and the outer sleeve at a desired height.

* * * * *